United States Patent [19]

Panttila et al.

[11] Patent Number: 5,069,394

[45] Date of Patent: Dec. 3, 1991

[54] DRIVE UNIT FOR THE REEL-UP OF A PAPER MACHINE OR PAPER FINISHING MACHINE

[75] Inventors: Väinö Panttila; Voitto Villgrén, both of Jyväskylä, Finland

[73] Assignee: Valmet Oy, Finland

[21] Appl. No.: 479,361

[22] Filed: Feb. 13, 1990

[30] Foreign Application Priority Data

Feb. 16, 1989 [FI] Finland ..... 890757

[51] Int. Cl.[5] ..... B65H 18/10

[52] U.S. Cl. ..... 242/67.1 R; 192/67 R; 192/85 CA

[58] Field of Search ..... 242/67.1 R, 78.1; 192/67 R, 85 CA

[56] References Cited

U.S. PATENT DOCUMENTS

| | | | |
|---|---|---|---|
| 3,198,455 | 8/1965 | Bond | 242/78.1 X |
| 3,406,600 | 10/1968 | Minick | 242/78.1 X |
| 3,537,665 | 11/1970 | Schumaker | 242/78.1 |
| 4,210,294 | 7/1980 | Jansen | 242/78.1 X |
| 4,482,039 | 11/1984 | Harris | 192/67 R |
| 4,507,926 | 4/1985 | Teckentrup et al. | 192/67 R X |
| 4,697,756 | 10/1987 | Kofler | 242/67.1 R |

*Primary Examiner*—John M. Jillions

*Attorney, Agent, or Firm*—Steinberg & Raskin

[57] ABSTRACT

The invention concerns a drive unit (10) for the center-wind reel-up of a paper machine or paper finishing machine, comprising means by which the rotation drive of the motor (11) is transferred to the shaft (19). In its interior, the shaft (19) comprises a transfer shaft (21) rotatable along with the shaft (19), said transfer shaft (21) being fitted to be displaceable on a coupling and uncoupling process in the direction of the longitudinal axis ($X_1$) of the shaft (19) by means of a cylinder device (22). When the transfer shaft (21) is displaced (arrow $L_1$) towards the coupling half (23*b*) of the central drum of the paper web roll (P), the coupling half (23*a*) of the drive unit attached to the end of the transfer shaft (21) is displaced into engagement with the web roll coupling half (23*b*). The invention further concerns a hydraulic operating system for the reel-up.

6 Claims, 5 Drawing Sheets

DRIVE UNIT FOR THE REEL-UP OF A PAPER MACHINE OR PAPER FINISHING MACHINE

BACKGROUND OF THE INVENTION

The invention concerns a drive unit for the reel-up, either an unwinder or a winder, of a paper machine or paper finishing machine as well as a hydraulic operating system for the drive unit.

In unwinding and winding of a paper web, the paper web roll is placed in a bearing cradle. The device that rotates the web is coupled to a coupling connected to the end of the center drum of the paper web roll. In the prior-art solutions, said coupling is carried out by means of various cumbersome lever mechanisms. Thus, the engagement or disengagement of the reel-up is a time-consuming working step.

SUMMARY OF THE INVENTION

The object of the invention is to overcome the drawback mentioned above and to provide a drive unit of an entirely novel type for a center-wind reel-up of a paper machine, wherein the coupling of the driving shaft of the drive unit with the center drum of the paper roll takes place automatically and rapidly. A further object of the invention is a hydraulic operating system for the drive unit of the center-wide reel-up, by whose means, besides the lubrication of the bearing points in the system, also the stopping of the system in a braking situation is carried out.

The object of the invention has been achieved by means of a solution comprising equipment wherein the coupling between the driving shaft and the center drum of the paper roll has been accomplished by means of a cylinder device.

The drive unit in accordance with the invention for the reel-up of a paper machine or paper finishing machine is mainly characterized in that in its interior the shaft comprises a transfer shaft rotated along with the shaft, said transfer shaft being fitted to be displaceable on a coupling and uncoupling process in the direction of the central axis of the shaft by means of a cylinder device, whereby, when the transfer shaft is displaced towards the counter-coupling half of the central drum of the paper web roll, the coupling half attached to the end of the transfer shaft is displaced into engagement with the counter-coupling half.

The hydraulic operating system in accordance with the invention for a drive unit of a reel-up of a paper machine or paper finishing machine is mainly characterized in that the system comprises a hydraulic brake which stops the rotation of the shaft and which is fitted to be operable in braking situations by means of the pressure produced by the hydraulic pump by means of which said hydraulic pump the operating pressure is also supplied for the cylinder device as is the lubricant for the lubrication of the bearings in the gearbox.

The commonest embodiment of the invention consists of an arrangement of equipment wherein the rotating motor is coupled directly to the shaft or wherein the rotating motor is coupled to the shaft by means of a V-belt, cogged belt, or any other member that transfers the movement of rotation, said shaft being further coupled with the transfer shaft and, by means of the coupling part connected to said transfer shaft, with the counter-coupling piece on the central drum of the paper roll.

The invention will be described in the following with reference to a preferred embodiment of the invention illustrated in the figures in the accompanying drawings, the invention being, however, not confined to said embodiment alone.

BRIEF DESCRIPTION OF THE DRAWINGS

FIG. 2C is an illustration of the transfer shaft taken along line A—A of FIG. 2B.

DESCRIPTION OF THE PREFERRED EMBODIMENTS

Figure 1B:
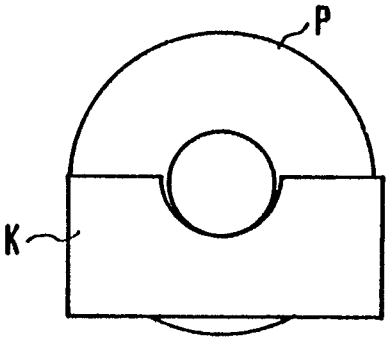
FIG. 1B is a sectional view taken along the line I—I in FIG. 1A. What is shown is the cradle of the paper roll, into which the paper roll is mounted for coupling by means of the drive unit.
Figure 1A:
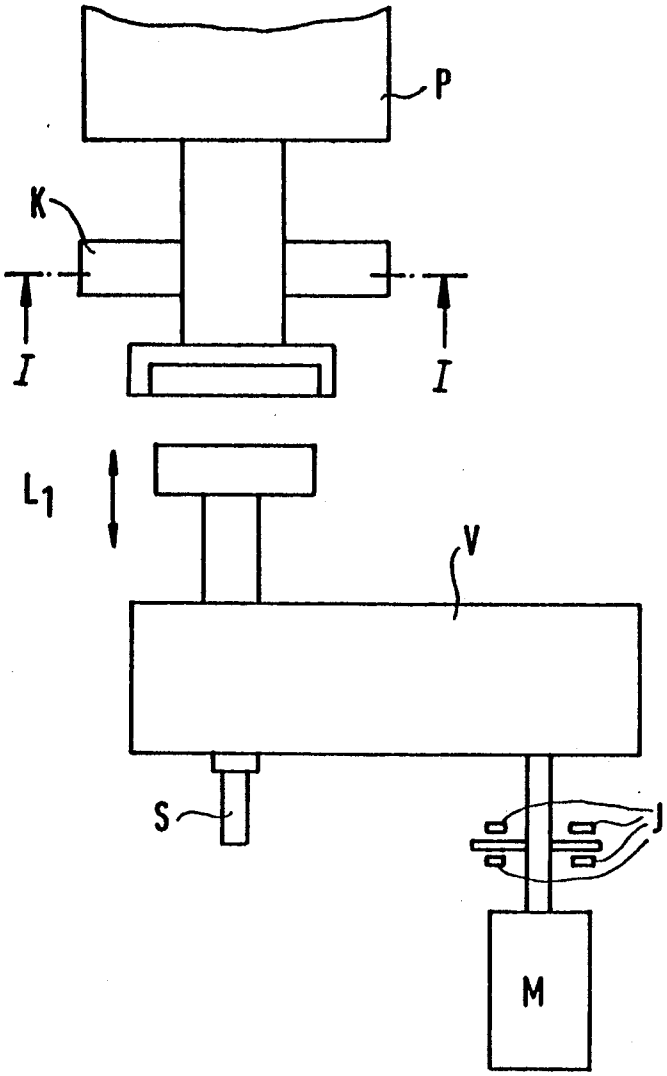
FIG. 1A is a schematical illustration of principle of a drive unit in accordance with the invention.

FIG. 1A is a schematical illustration of a drive unit in accordance with the invention for the reel-up of a paper machine or paper finishing machine. The paper roll P is mounted in bearing cradles K. As is shown in FIG. 1A, the output shaft of the gearbox V is coupled with the fastening members at the end of the central drum of the paper roll (arrow $L_1$). The rotating drive is passed from the motor M through the brake J to the input shaft of the gearbox V and transferred further inside the gearbox from a smaller cogwheel to a larger cogwheel and then further to the output shaft of the gearbox, the coupling fitted on said output shaft being displaced by a cylinder device S in accordance with the invention.

FIG. 1B is a sectional view taken along the line I—I in FIG. 1A. From the figure it is seen that the bearing cradle K consists of a crescent-shaped bearing housing opening upwards, whereby the paper web roll P can be lowered freely onto the bearings.

Figure 2A:
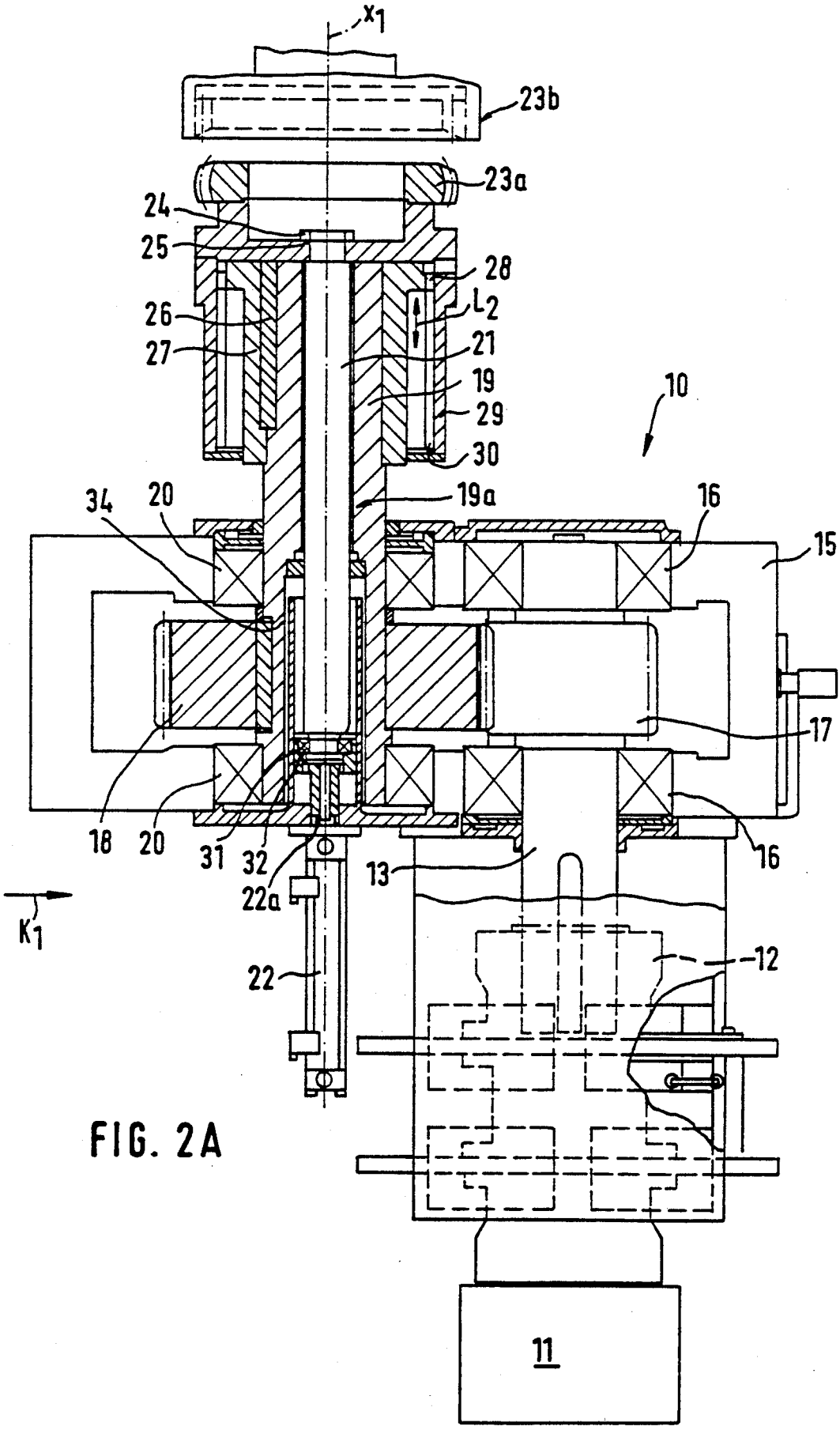
FIG. 2A is a partly sectional top view of a drive unit in accordance with the invention for the reel-up of a paper machine or paper finishing machine.

FIG. 2A is a partly sectional top view of a preferred embodiment of a drive unit 10 in accordance with the invention for a center-wind reel-up of a paper machine or paper finishing machine. The motor 11, which is advantageously an electric motor, rotates the shaft 13 by means of a toothed coupling, said shaft 13 being attached to the toothed coupling 12 by means of a key 14. The motor 11 is coupled with the other end of the toothed coupling advantageously by means of a toothed connection, an inner bushing attached to the output shaft of the motor 11 being coupled with an inner toothing in the toothed coupling 12.

The shaft 13 is rotated further on the bearings 16 in the bearing housing 15, and the shaft 13 comprises a cogwheel 17 which is functionally connected with a driven larger cogwheel 18. The shaft 19 of the cogwheel 18 is mounted so as to revolve on bearing means 20 in the bearing housing 15.

Inside the shaft 19 there is a transfer shaft 21, with which the cylinder device 22 is coupled by its piston rod 22*a*. The transfer shaft 21 is passed through the central bore 19*a* in the shaft 19, and at its outer end it comprises a coupling half 23*a*, which is connected to a coupling half 23*b* placed on the central drum of the paper web roll in a coupling operation.

The coupling half 23*a* is attached to the transfer shaft 21 by means of a nut 24. Between the coupling half 23 and the nut 24 there is a lock washer 25.

The inner bushing 27 is attached to the outer face of the shaft 19 by means of a key 26. The inner bushing 27 comprises an outside toothing 28, which is jointly operative with the inside toothing 30 of the outer bushing 29. The outer bushing 29 is attached by its end in a fixed position on the coupling half 23*a*. The toothings 30 and 28 are fitted, as is indicated by the arrows $L_2$, as gliding relative to one another in a coupling process.

The end of the transfer shaft 21 that is placed next to the cylinder 22 is attached revolvingly by the bearing housing 31 to its bearing means 32.

Thus, the inner transfer shaft 21 revolves at the same angular velocity as the shaft 19. However, the piston rod 22*a* in the cylinder device 22 must not revolve, and this is ensured by means of a key arrangement 33.

Figure 2B:
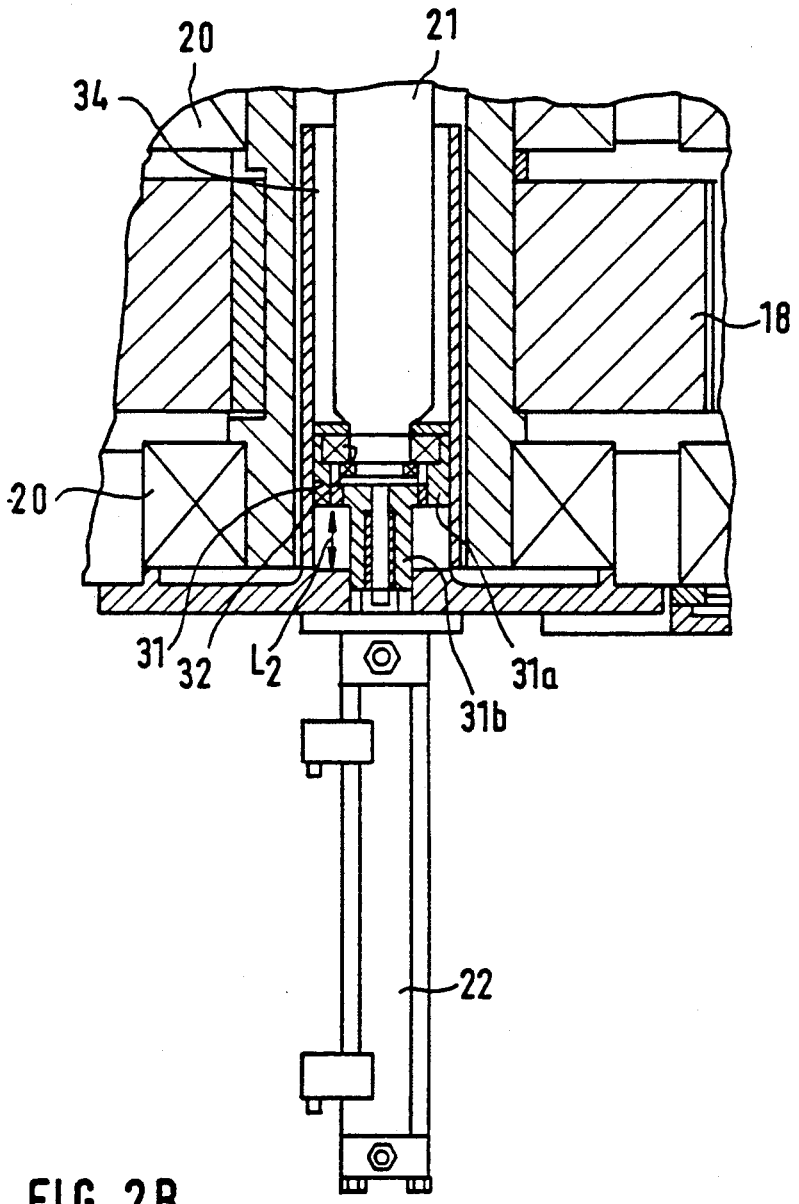
FIG. 2B is a more detailed illustration of the journalling of the end of the transfer shaft.

FIG. 2B is a more detailed illustration of the journalling of the transfer shaft 21.

The bearing housing 31 is fitted as gliding in a guide bushing 34 inside the bearing housing 15. Said gliding movement is illustrated by the arrows $L_2$ in FIG. 2A. The bearing housing 31 comprises a body portion 31*a* proper and a related projecting projection end 31*b* of the bearing housing, said projection end being attached to the end of the piston rod 22*a* of the cylinder device 22 by means of a screw arrangement. Revolving of the bearing housing 31 is prevented by means of a key arrangement. The bearing housing 31 is provided with a groove (not shown), which runs on a key which has been bolted to the guide bushing 34. In this way, revolving movement is prevented, but longitudinal movement is permitted.

Thus, on a coupling process an extension of the output shaft 19 of the gearbox is permitted by means of the transfer shaft arrangement as the cylinder device 22 displaces the transfer shaft 21 during a process of uncoupling and coupling.

Figure 3:
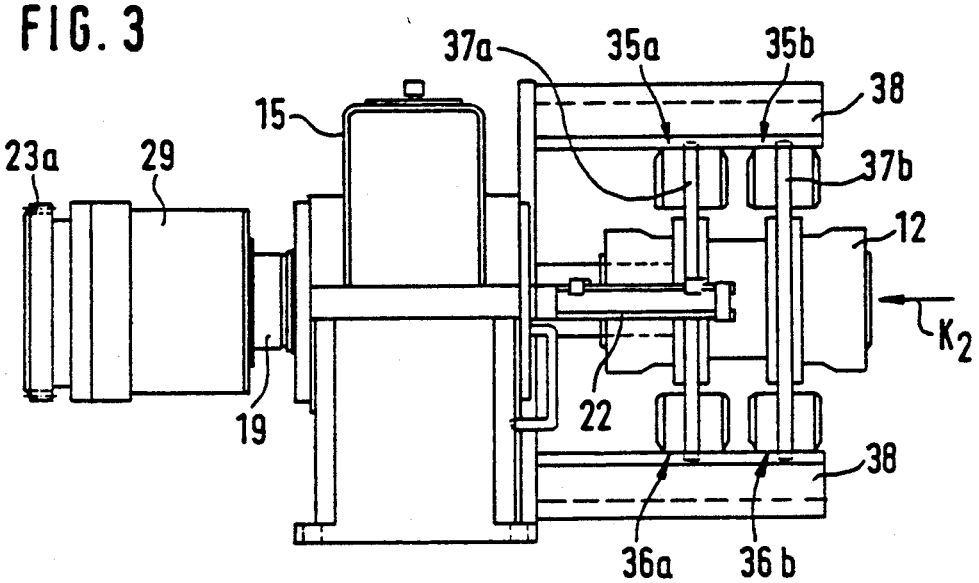
FIG. 3 shows the drive unit shown in FIG. 2A as seen in the direction of the arrow $K_1$ in FIG. 2A.

FIG. 3 shows a drive unit in accordance with the invention seen in the direction of the arrow $K_1$ in FIG. 2A. As is shown in FIG. 3, the drive unit comprises upper brake shoes 35*a* and 35*b* and lower brake shoes 36*a* and 36*b*. Each brake shoe comprises four hydraulic piston devices. The brake shoes 35*a* and 36*a* are fitted to operate a brake disk 37*a*, and the brake shoes 35*b* and 36*b* are fitted to operate a brake disk 37*b*. The brake disks 37*a* and 37*b* are fixed permanently to the outer face of the toothed coupling 12. The brake shoes may be entirely conventional hydraulic brake devices, wherein the hydraulic piston is fitted, by means of hydraulic pressure, to press the brake pad against the brake disk 37*a*, 37*b*. The brakes shoes 35*a* . . . 36*b* are fixed to a brake stand 38. The figure does not show the drawing of the hydraulic piping to the piston devices that operate the brake pads of the brake shoes.

Figure 4:
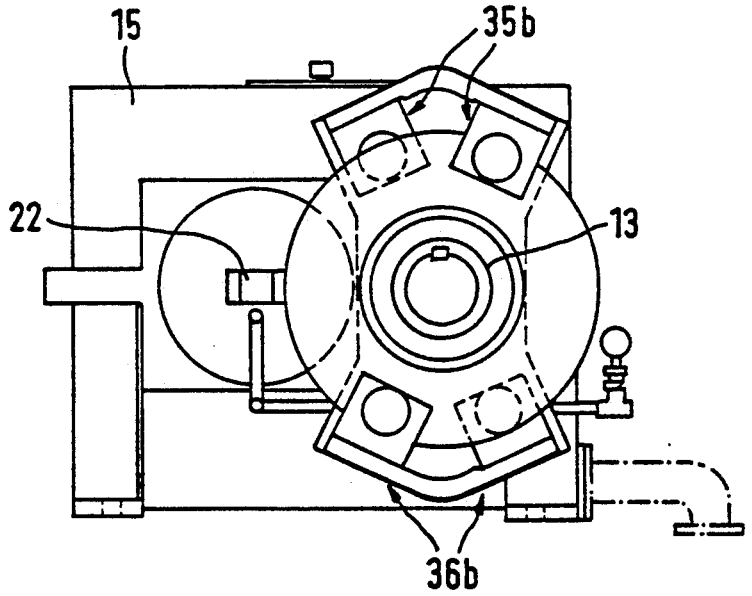
FIG. 4 shows the drive unit seen in the direction of the arrow $K_2$ in FIG. 3.

FIG. 4 shows a drive unit in accordance with the invention for a center-wind reel-up of a paper machine or paper finishing machine seen in the direction of the arrow $K_2$ in FIG. 3. The figure shows the symmetric locations of the brake cylinders of the upper brake shoe and the lower brake shoe relative to the center line of the shaft 13 to be stopped. The drawing of the hydraulic piping to the piston devices of the brake shoes is not shown separately in the figure.

The commonest embodiment of the invention (not shown in the figures) consists merely of a arrangement of equipment wherein the rotating motor 11 is coupled directly to the shaft 19 or wherein the rotating motor 11 is coupled to the shaft 19 by means of a V-belt, cogged belt, or any other member that transfers the movement or rotation, said shaft 19 being further coupled with the transfer shaft 21 and, by means of the coupling part 23*a* connected to said transfer shaft 21, with the counter-coupling piece on the central drum of the paper roll. In this commonest embodiment the arrangement of equipment between the transfer shaft 21 and the shaft 19 is entirely similar to that in the particular embodiment of the invention shown in FIGS. 2A and 2B.

Figure 5:
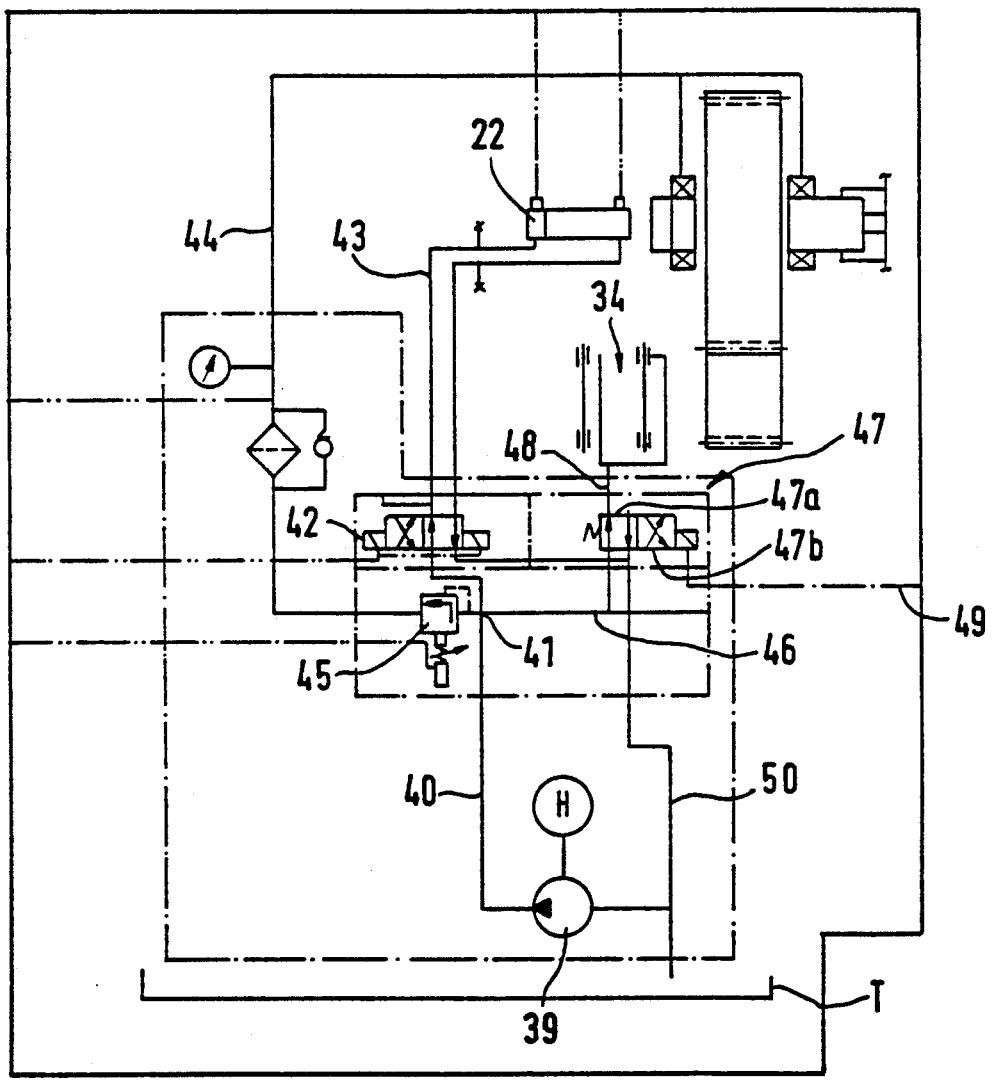
FIG. 5 is a schematical illustration of a hydraulic operating system in accordance with the invention for the drive unit.
Figure 2A:
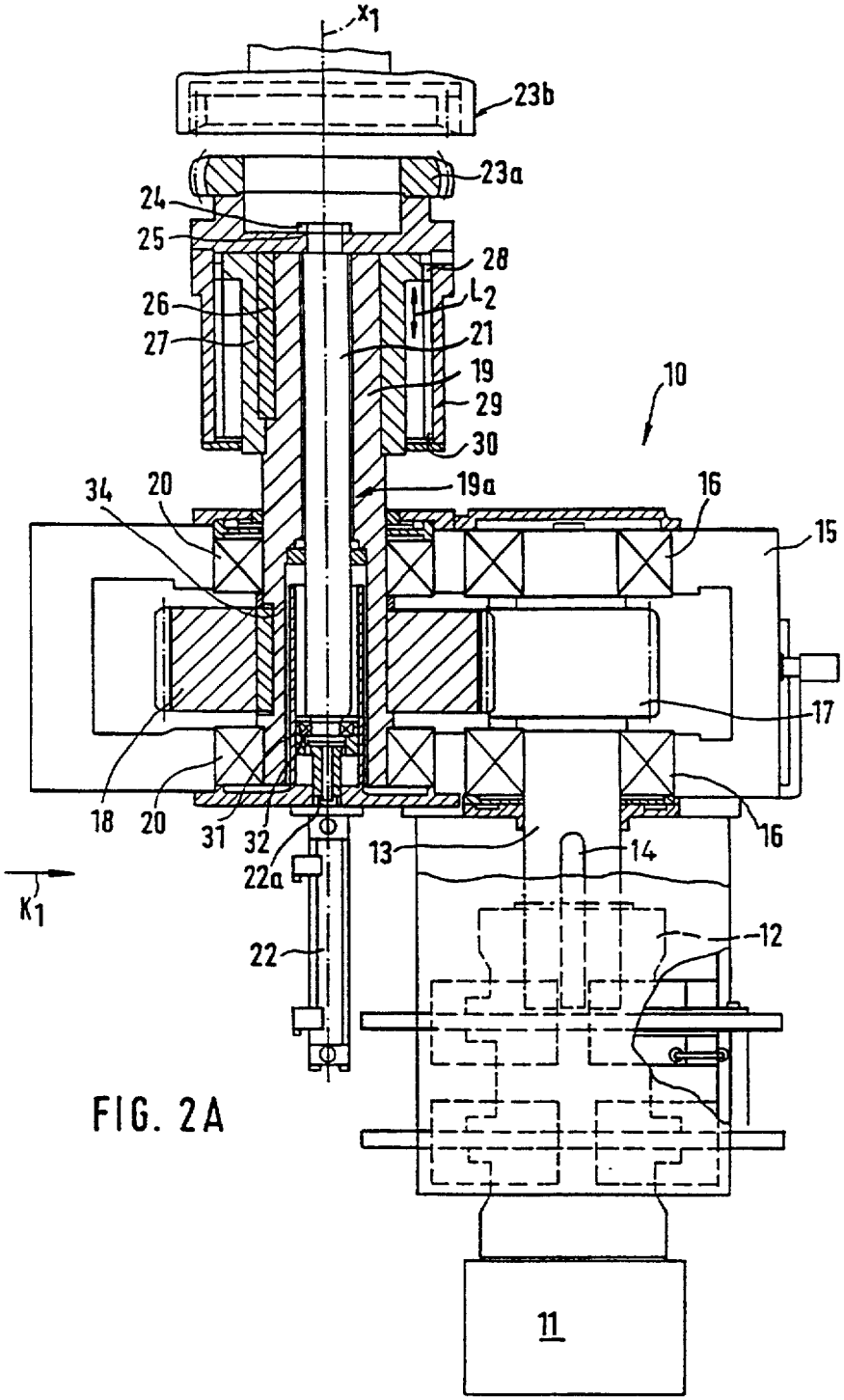
Figure 2B:
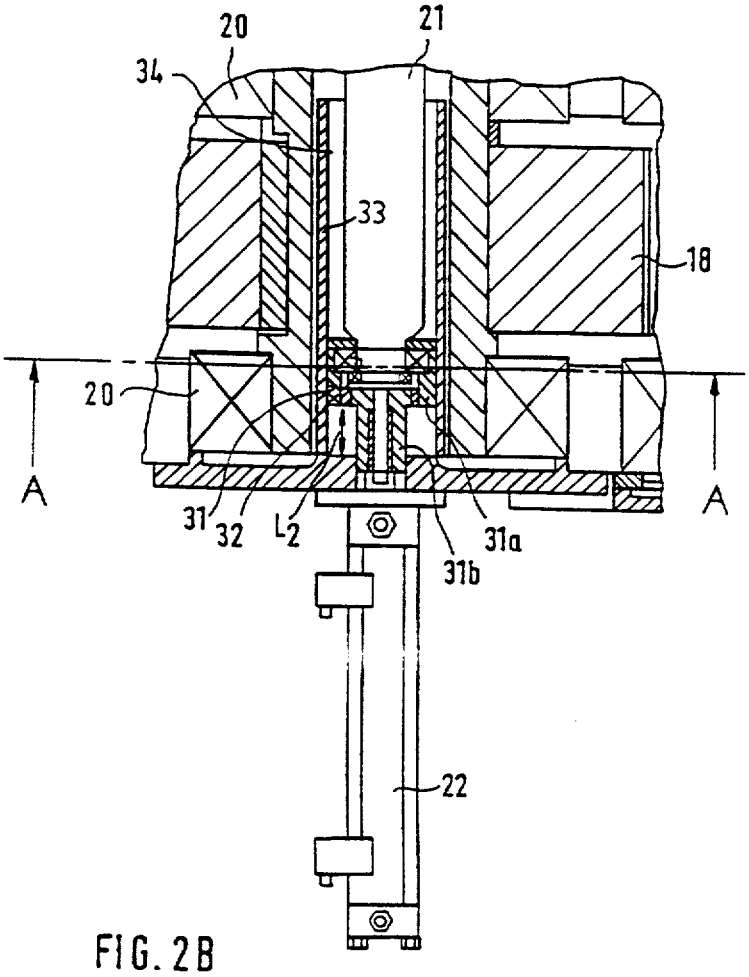

FIG. 5 is a schematical illustration of a hydraulic operating system for a drive unit in accordance with the invention for a center-wind-reel-up of a paper machine or paper finishing machine. The brake fitted on the rapid shaft of the drive unit stops the mechanism. The brake receives the necessary hydraulic fluid pressure from the lubrication unit, which is constructed in such a way that, in a braking situation, the unit is capable of providing the necessary pressure of 45 bars. In normal operation, the pressure is 10 bars. As is shown in FIG. 5, the motor M rotates the hydraulic pump 39, which supplies the pressurized hydraulic fluid and transfers it along the duct 40 to the branching point 41 and further to the electrically controlled twin-block direction valve 42. From the directional valve 42 a pressure line 43 passes to the hydraulic cylinder 22 and an exhaust line from the cylinder 22 through the valve 42 further to the tank T. From the branching point 41 a line 44 passes further to the lubrication of the bearings. The line 44 includes a pre-controlled pressure reduction valve 45. Further, from the branching point 41, a line 46 passes to the twin-block directional valve 47. The block 47 in the valve is on when no electric control is passed to the valve 47. In such a case the pressurized medium is passed from the line 46 to the line 48 and further to the hydraulic brake 34. When the valve block 47*b* is switched on while the control spindle is activated by means of a voltage supplied along the electric pre-control line 49, the line 46 is blocked, and the hydraulic pressure is not passed to the hydraulic brake 34. In such a case the hydraulic circuit 48 of the brake 34 communicates through the block 47*b* with the return line 50.

According to the invention, when the pre-controlled pressure reduction valve 45 is acted upon by means of electric control, the relief valve is opened and thereby a lower operating pressure is provided for situations of normal operation. In normal operation, the pressure in the system is about 10 bars. When electric pre-control is not passed to the valve 45, the valve is controlled so that the pressure reduction valve chokes the flow and produces a higher pressure for the system, the attained pressure and the necessary braking pressure being about 45 bars. According to the invention, the hydraulic cylinder and the other devices are fitted such that they endure said braking pressure of 45 bars.

What is claimed is:

1. A drive unit for the center-wind reel-up of a paper machine or paper finishing machine comprising:

a motor;

a shaft;

means for connecting said motor and said shaft such that rotational drive of said motor is transferred to said shaft;

a coupling half;

a transfer shaft abutting said coupling half and located so as to abut said shaft and be rotatable with said shaft, said transfer shaft being fitted inside said shaft and displaceable along a longitudinal axis of said shaft such that said coupling half of said drive unit can be coupled and uncoupled with a coupling half of a central drum of a paper web roll;

bearing means located inside said shaft, said bearing means enabling said transfer shaft to rotate while allowing said transfer shaft to be moved along said longitudinal axis during said coupling and uncoupling with said coupling half;

a cylinder drive for displacing said transfer shaft along said longitudinal axis of said shaft;

an outer bushing connected to said transfer shaft through said coupling half, and an inner bushing abutting said shaft, said outer bushing comprising an inner toothing which moves slidably along an outside toothing of said inner bushing when said transfer shaft moves.

2. The drive unit of claim 1, wherein said bearing means comprises a first bearing housing and a plurality of bearings within said first bearing housing, said transfer shaft being articulated at one end so as to revolve in the bearings of said first bearing housing such that said first bearing housing moves in a direction parallel to said longitudinal axis of said shaft.

3. The drive unit of claim 2, further comprising a guide bushing in which said first bearing housing is fitted, a second bearing housing being slidable relative to inner faces of said guide bushing, and a key device arrangement abutting said first bearing housing and preventing rotation thereof.

4. The drive unit of claim 1, wherein said cylinder device comprises a piston rod attached to said transfer shaft.

5. The drive unit of claim 1, wherein said coupling half of said drive unit comprises toothings which can be coupled with toothings of said coupling half of said central drum of said paper web roll.

6. The drive unit of claim 1, further comprising a third shaft rotated by said motor, a first cogwheel mounted on said third shaft, and a second cogwheel mounted on said shaft such that said first cogwheel drives said second cogwheel.

* * * * *

UNITED STATES PATENT AND TRADEMARK OFFICE

CERTIFICATE OF CORRECTION

PATENT NO. :5,069,394

DATED : December 3, 1991

INVENTOR(S) :Vaino Panttila, et. al.

It is certified that error appears in the above-identified patent and that said Letters Patent is hereby corrected as shown below:

The title page should be deleted to appear as per attached title page.

Figures 2A and 2B should be deleted to be replaced with Figures 2A and 2B as on the attached sheets.

Signed and Sealed this

Eighth Day of November, 1994

*Attest:*

Bruce Lehman

BRUCE LEHMAN

*Attesting Officer*

*Commissioner of Patents and Trademarks*

United States Patent [19]

Panttila et al.

[11] Patent Number: 5,069,394

[45] Date of Patent: Dec. 3, 1991

[54] DRIVE UNIT FOR THE REEL-UP OF A PAPER MACHINE OR PAPER FINISHING MACHINE

[75] Inventors: Väinö Panttila; Voitto Villgrén, both of Jyväskylä, Finland

[73] Assignee: Valmet Oy, Finland

[21] Appl. No.: 479,361

[22] Filed: Feb. 13, 1990

[30] Foreign Application Priority Data

Feb. 16, 1989 [FI] Finland ..... 890757

[51] Int. Cl.[5] ..... B65H 18/10

[52] U.S. Cl. ..... 242/67.1 R; 192/67 R; 192/85 CA

[58] Field of Search ..... 242/67.1 R, 78.1; 192/67 R, 85 CA

[56] References Cited

U.S. PATENT DOCUMENTS

| | | | |
|---|---|---|---|
| 3,198,455 | 8/1965 | Bond | 242/78.1 X |
| 3,406,600 | 10/1968 | Minick | 242/78.1 X |
| 3,537,665 | 11/1970 | Schumaker | 242/78.1 |
| 4,210,294 | 7/1980 | Jansen | 242/78.1 X |
| 4,482,039 | 11/1984 | Harris | 192/67 R |
| 4,507,926 | 4/1985 | Teckentrup et al. | 192/67 R X |
| 4,697,756 | 10/1987 | Kofler | 242/67.1 R |

*Primary Examiner*—John M. Jillions

*Attorney, Agent, or Firm*—Steinberg & Raskin

[57] ABSTRACT

The invention concerns a drive unit (10) for the center-wind reel-up of a paper machine or paper finishing machine, comprising means by which the rotation drive of the motor (11) is transferred to the shaft (19). In its interior, the shaft (19) comprises a transfer shaft (21) rotatable along with the shaft (19), said transfer shaft (21) being fitted to be displaceable on a coupling and uncoupling process in the direction of the longitudinal axis ($X_1$) of the shaft (19) by means of a cylinder device (22). When the transfer shaft (21) is displaced (arrow $L_1$) towards the coupling half (23*b*) of the central drum of the paper web roll (P), the coupling half (23*a*) of the drive unit attached to the end of the transfer shaft (21) is displaced into engagement with the web roll coupling half (23*b*). The invention further concerns a hydraulic operating system for the reel-up.

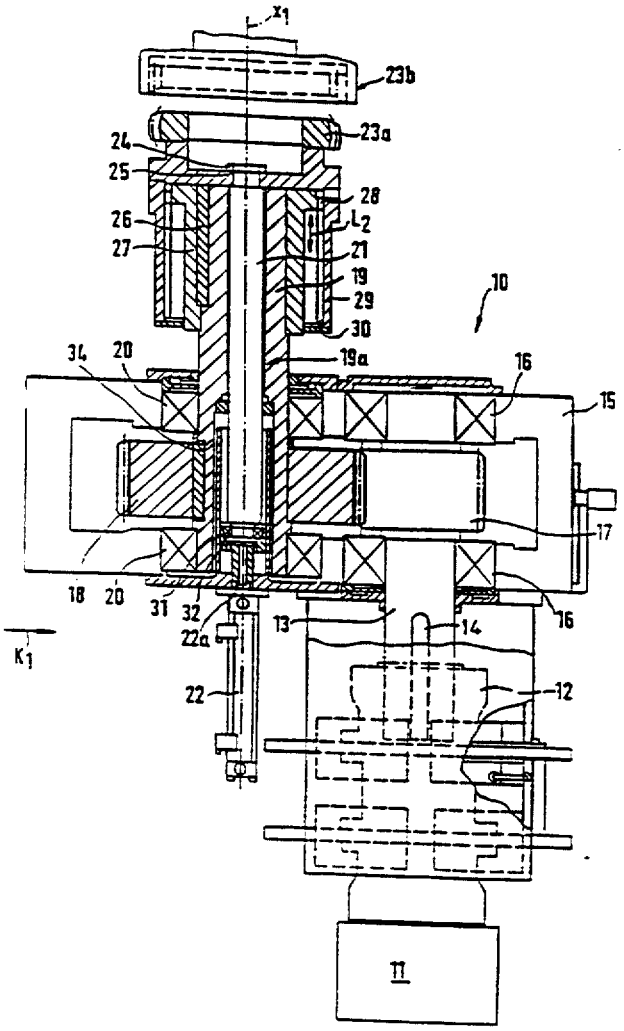

6 Claims, 5 Drawing Sheets